United States Patent [19]

Ros

[11] Patent Number: 4,713,951

[45] Date of Patent: Dec. 22, 1987

[54] SEPARABLE KEY HOLDER

[75] Inventor: Johannes F. Ros, LT Blaricum, Netherlands

[73] Assignee: Innovative Concepts Europe B.V., Netherlands

[21] Appl. No.: 794,725

[22] Filed: Nov. 4, 1985

[51] Int. Cl.[4] ..... A47G 29/10

[52] U.S. Cl. ..... 70/456 R; 70/457; 70/459; 292/19; 292/37

[58] Field of Search ..... 70/456 R–459; 24/3, 16 PB, 150 FP, 297; 292/DIG. 38, 19, 37, 87, 27

[56] References Cited

U.S. PATENT DOCUMENTS

| | | | |
|---|---|---|---|
| Re. 27,357 | 5/1972 | Merser | 24/150 FP |
| 857,922 | 6/1907 | Campbell | 292/27 |
| 988,114 | 3/1911 | La Belle | 292/27 |
| 1,199,690 | 9/1916 | Gillan | 70/457 |
| 1,484,532 | 2/1924 | Quigley | 70/456 R |
| 2,307,808 | 1/1943 | Segal | 70/459 X |
| 2,599,660 | 6/1952 | Poutinen | 70/457 X |
| 2,668,070 | 2/1954 | Schmitt | 292/27 |
| 2,676,822 | 4/1954 | Modrey | 70/457 |
| 2,702,928 | 3/1955 | Nielsen | 70/457 X |
| 2,784,475 | 3/1957 | Schmitt | 292/27 |
| 2,892,537 | 6/1959 | Schwartz | 70/456 R |
| 2,975,497 | 3/1961 | Budreck | 70/457 X |
| 3,600,917 | 8/1971 | Krock | 70/459 |
| 3,621,690 | 11/1971 | Whitcomb | 70/456 R |
| 3,695,074 | 10/1972 | Smyth et al. | 70/456 R |
| 3,712,655 | 1/1973 | Fuehrer | 24/16 PB |
| 3,968,669 | 7/1976 | Coleman | 70/456 R |
| 3,979,934 | 9/1976 | Isenmann | 70/459 |
| 4,403,377 | 9/1983 | Mizusawa | 24/297 |
| 4,500,120 | 2/1985 | Ridgewell et al. | 292/19 |

*Primary Examiner*—Robert L. Wolfe
*Assistant Examiner*—Suzanne L. Dino
*Attorney, Agent, or Firm*—Arnold S. Weintraub

[57] ABSTRACT

Disclosed is a separable key holder comprising a holder body in which a pin is fitted on either side, each pin being provided with a ring-shaped element for the accommodation of keys. The holder body consists of two portions to be detachably coupled to each other, each of the portions carrying one of the pins. The two portions of the holder body are coupled to one another by a snap connection which can be released by an axial displacement of one of said pins in the respective portion of the holder body.

9 Claims, 3 Drawing Figures

SEPARABLE KEY HOLDER

BACKGROUND OF THE INVENTION

The present invention relates to a separable key holder comprising a holder body in which a pin is fitted on either side, each pin being provided with a ring-shaped element for the accommodation of keys, the holder body consisting of two portions to be detachably coupled to each other, each of said portions carrying one of said pins.

A separable key holder of this type is known from U.S. Pat. No. 3,041,697 and permits for example that automobile keys can be segregated from the remaining keys. In said known key holder the two portions of the holder body are connected by means of a magnetical coupling, which can be released by pulling the magnets from one another.

U.S. Pat. No. 3,979,934 discloses a separable key holder in which the two members are joined by means of a snap connection. To release said connection it is necessary to manually press upon the flexible elements which form part of said snap connection.

SUMMARY OF THE INVENTION

It is an object of the present invention to provide a separable key holder having a mechanical coupling that is easy to handle and to manufacture.

The above mentioned object is achieved according to the invention in that the two portions of the holder body can be coupled to each other by means of a snap connection, which snap connection can be released by an axial displacement of one of the pins in the respective portion of the holder body. The tow portions of the holder body are joined in a particularly simple manner and cannot unintentionally be separated.

SURVEY OF THE DRAWINGS

DESCRIPTION OF THE PREFERRED EMBODIMENTS

Figure 1:
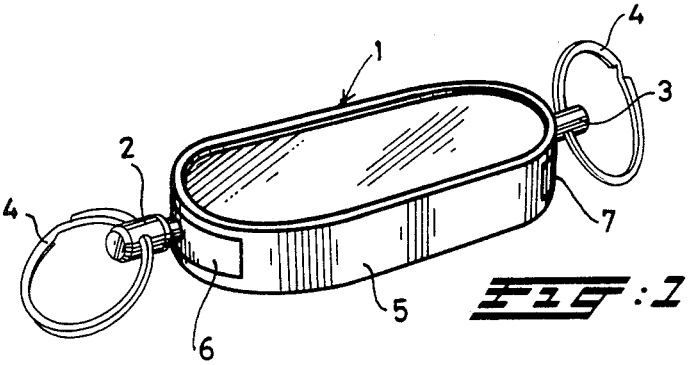
FIG. 1 shows a perspective view of the key holder according to the invention.

Referring to FIG. 1, the key holder according to the invention consists of a holder body 1 to which a pin 2 and 3 is fitted on either side, each pin being provided with a conventional key-ring 4.

As can be seen from FIGS. 2 and 3, the holder body 1 consists of two portions, viz. a first portion consisting of a sleeve 5 which is terminated at one extremity by a coupling element 6 fixed to it, and a second portion 7 which can be slid into the sleeve and can be joined to the coupling element in a manner to be described below.

In the embodiment shown the sleeve 5 of the first portion has an oblong flat form with rounded extremities.

The coupling element 6 is provided with an axial drilled hole 8, the centre line of which coincides with the longitudinal centre line of the sleeve 5. In the drilled hole 8 there is mounted the pin 2, the extremity of which projects outside the sleeve and is provided with a widened section 9 having, situated transversely to the longitudinal centre line of the pin, a drilled hole 10 in which the key-ring 4 or similar can be fitted.

The coupling element 6 is secured in the sleeve 5 by means of two spring lips 11, 11′ on either side of the coupling element which are provided at their extremities with a hook-shaped element 12, 12′. The spring lips 11, 12; 11′, 12′, which essentially extend in the longitudinal direction of the sleeve, form a snap connection with projections 13, 13′ provided on the inside of the sleeve 5.

The coupling element 6 is further provided with two spring lips 14, 14′ which are situated between the lips 11, 11′ on either side of the drilled hole 8 and which likewise extend in the longitudinal direction inside the sleeve. The lips 14, 14′ are provided at their extremities with hook-shaped elements 15, 15′.

The surfaces of the lips 14, 14′ facing each other are provided with a protrusion 16, 16′ which are, close to each other near the longitudinal centre line of the sleeve, and which protrusions cooperate with the pin 2 in a manner to be described in more detail below.

At its extremity remote from the widened section 9 the pin 2 is provided with a narrowed section which is formed by a conical surface 17 which extends into a narrowed cylindrical section 18. The cylindrical section 18 thereafter merges steplike into a widened end piece 19 of the pin.

The protrusions 16, 16′ have an essentially triangular shape with a sloping side 20, 20′ which is directed towards the conical surface 17 of the pin 2, and a side 21, 21′ is situated perpendicular to the longitudinal centre line of the pin 2 and which is in contact with the steplike widening of the end piece 19 of the pin 2 for securing said pin. The extremities of the protrusions 16 and 16′ directed towards each other enclose between themselves the narrow cylindrical section 18 of the pin.

Figure 2:
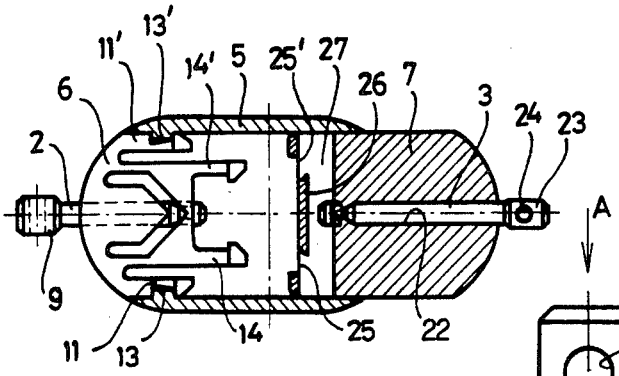
FIG. 2 shows a cross-section of the key holder in FIG. 1, the two sections being moved apart to some extent.

The second portion 7 of the holder body 1 has a drilled hole 22, extending in the longitudinal direction of the sleeve 5, in said hole there is mounted in a suitable manner the pin 3 which has a head 23 having a transverse drilled hole 24 in which a key-ring 4 can be fitted (see FIG. 2).

The second portion 7 is, moreover, provided with two openings 25, 25′ which are provided in the wall 26 of the portion 7 facing the coupling element 6. The openings 25 and 25′ provide access to a cavity 27 provided in the portion 7 and are intended to accommodate the hook-shaped elements 15, 15′ of the spring lips 14, 14′.

Figure 3:
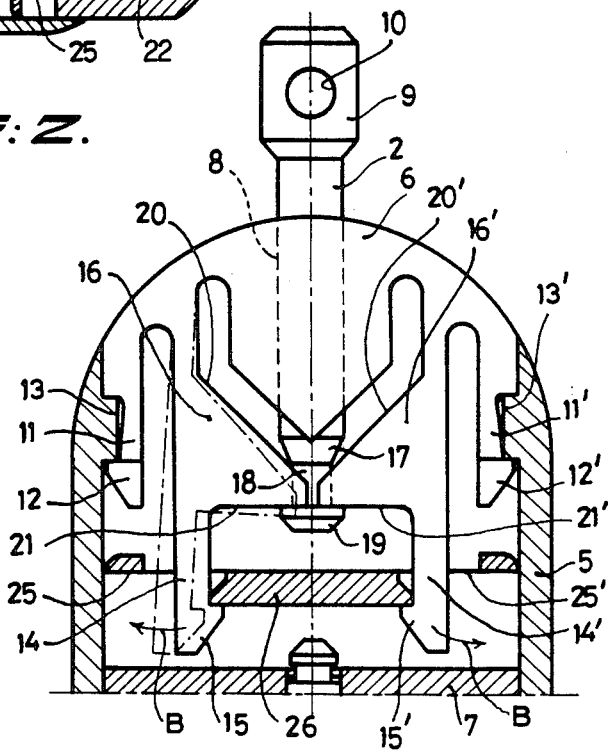
FIG. 3 shows on a larger scale a detail of the cross-section in FIG. 2, the two sections being depicted in the coupled state.

In FIG. 3 the key holder is depicted in a position in which the first portion 5, 6 and the second portion 7 are coupled to each other. The hook-shaped elements 15, 15′ project respectively into the opening 25 and 25′ and latch behind the wall 26.

The uncoupling of the two sections of the key holder takes place in the following manner. From the position depicted in FIG. 3 the pin 2 is moved in the axial direction indicated by the arrow A. As a result of this the conical surface 17 of the pin comes into contact with the sloping sides 20, 20′ of the protrusions 16, 16′, as a result of which the lips 14, 14′ rotate resiliently in the direction of the arrows B. On pressing in the pin 2, the lips 14, 14′ will take up the position indicated in FIG. 3 for the lip 14 by dotted lines, in which position the hook-shaped elements 15, 15′ release the second portion 7. The second portion 7 can then be slid out of the sleeve 5 as depicted in FIG. 2.

When the pressure on the pin 2 is relaxed, as a result of the spring force of the lips 14, 14' the said pin will be pressed back to the starting position by the pressure exerted by the sloping faces 20 and 20' on the conical surface 17. In this situation the protrusions 16, 16' also have a function in retaining the pin via the narrowed section and the end piece 19.

If it is desired later to attach the second portion to the first portion again, it is only necessary to slide the said second portion 7 into the sleeve 5 until the hook-shaped elements 15, 15' again latch into the openings 25, 25'.

It will be clear that within the scope of the invention a large number of variations are possible. Thus, the coupling element 6 can also be secured in a different manner in the sleeve or the hook-shaped elements and the recess 27 in the second section 7 may also have a different configuration.

What is claimed is:

1. A separable holder comprising a holder body in which a pin is fitted on either side, each pin being provided with a ring-shaped element for the accommodation of keys, the holder body consisting of two detachably couplable portions, each of said portions carrying one of said pins, in which the two portions of the holder body can be coupled to each other by means of a snap connection, in which one portion of the holder body comprises a sleeve-shaped element closed at one extremity, and the other portion can be accommodated within said element, said sleeve-shaped element being provided with hook-shaped spring lips, integrally formed therewith, which can latch into suitable cavities in the other portion to form the snap connection, which snap connection can be released by an axial displacement of one of the pins in the respective portion of the holder body.

2. The key holder according to claim 1, in which the spring lips are provided with triangular shaped protrusions which can cooperate with a conical surface of the pin mounted in the sleeve-shaped element in order to displace the lips in a lateral direction to resiliently release the snap connection.

3. The key holder according to claim 1 in which the sleeve-shaped element consists of a sleeve in which a coupling element is mounted at one extremity, which coupling element has an axial drilled hole to receive the respective pin, and the hook-shaped spring lips extend in the axial direction inside said sleeve.

4. The key holder according to claim 3, in which the pin mounted in the coupling element is provided near the extremity remote from the ring-shaped element with a narrowed section which, proceeding in a direction from the end bearing the ring-shaped element, first has a conical surface which merges into a narrow cylindrical surface which terminates in a widened end piece of the pin, the protrusions of the spring lips are adapted to enclose and said narrowed section of the pin, which protrusions each have a sloping face which cooperates with the conical surface and a face situated perpendicularly to the longitudinal center line of the sleeve which cooperates with the step-like widening of the end piece for securing said pin.

5. Key holder according to claim 3, in which the coupling element is manufactured from a resilient plastic material and is retained in the sleeve by means of a snap connection.

6. A separable key holder comprising a holder body including two ends with a pin fitted on each of said two ends, each pin being provided with a ring-shaped element for the accommodation of keys, the holder body formed by two detachably coupling portions, each of said portions carrying one of said pins, the two portions of the holder body being couplable to each other by means of a snap connection, one portion of the holder body being a sleeve-shaped element closed at one extremity, with an axially drilled hole disposed in said extremity and the other portion being slidingly receivable within said sleeve-shaped element, said sleeve-shaped element including integrally formed, resilient hook-shaped spring lips extending axially and resiliently engageable with suitable cavities formed in the other portion to form the snap connection, said spring lips being provided with triangular shaped protrusions, wherein the pin carried by the sleeve-shaped coupling element is mounted thereto through the axially drilled hole therein and axially displaceable therethrough and is provided near an end remote from the ring-shaped element with a narrowed section which, proceeding in a direction from the end bearing the ring-shaped element, first has a conical surface, which then merges into a narrow cylindrical surface, which then terminates step-like into a widened end piece, said conical surface cooperating with a sloping face carried on each of the triangular shaped protrusions to resiliently displace the lips in the lateral direction and release the snap connection by axial displacement of the sleeve-shaped element mounted pin said sloping faces being disposed perpendicularly to the longitudinal center line of the sleeve shaped member.

7. A separable key holder comprising:

a first sleeve member comprising:

an axially disposed orifice opening into one end thereof;

a coupling pin slidingly receivable in the orifice and having a first and second end thereof, the first end being provided with a first ring-shaped element for the accommodation of keys thereon and the second end comprising:

a narrowed cylindrical portion; and a conical portion; and a pair of resilient spring lips axially extending inside the sleeve and integral therewith, each of the pair having a free end thereof, said free end terminating in a hook-shaped tip, and each of the pair being provided with a triangular shaped protrusion adapted to cooperate with the conical portion to resiliently and laterally displace the lips; and a second member adapted to be slidingly received in the first member and comprising:

a fixed pin mounted to one end thereof and provided with a second ring-shaped member for the accommodation of keys thereon; and a pair of apertures adapted to receive and engage the hook-shaped tips;

wherein, when the coupling pin is axially displaced, the conical section thereof engages the cooperating protrusions of the lips and laterally displaces said lips, thereby permitting the hooked tips thereof to disengage from the apertures and the two holder members to be detached from each by axially displacing them with respect to each other.

8. The key holer of claim 7 wherein the second end of the coupling pin further comprises a widened end piece adjacent the cylindrical portion.

9. The key holder of claim 6 wherein the holder members are disengaged by axially displacing the coupling pin in a direction toward the center of the holder.

* * * * *